US009598235B2

(12) United States Patent
Vasilescu et al.

(10) Patent No.: US 9,598,235 B2
(45) Date of Patent: Mar. 21, 2017

(54) MOTOR VEHICLE FOR COLLECTING AND SORTING MATERIAL AND METHOD OF DOING SAME

(71) Applicant: Shred-Tech Corporation, Cambridge (CA)

(72) Inventors: Constantin Vasilescu, Cambridge (CA); Justin Johns, Hamilton (CA)

(73) Assignee: SHRED-TECH CORPORATION, Ontario (CA)

( * ) Notice: Subject to any disclaimer, the term of this patent is extended or adjusted under 35 U.S.C. 154(b) by 519 days.

(21) Appl. No.: 13/840,868

(22) Filed: Mar. 15, 2013

(65) Prior Publication Data

US 2013/0259614 A1 Oct. 3, 2013

Related U.S. Application Data

(60) Provisional application No. 61/616,979, filed on Mar. 28, 2012.

(51) Int. Cl.

| | |
|---|---|
| ***B65B 21/02*** | (2006.01) |
| ***B65F 3/14*** | (2006.01) |
| ***B65F 3/02*** | (2006.01) |
| ***B65F 3/00*** | (2006.01) |
| ***B65F 3/08*** | (2006.01) |

(52) U.S. Cl.

CPC ..... *B65F 3/14* (2013.01); *B65F 3/001* (2013.01); *B65F 3/02* (2013.01); *B65F 3/08* (2013.01); *B65F 2003/023* (2013.01)

(58) Field of Classification Search

USPC ..... 414/409, 406

See application file for complete search history.

(56) References Cited

U.S. PATENT DOCUMENTS

| | | | | |
|---|---|---|---|---|
| 4,915,570 | A * | 4/1990 | Rath | B65F 3/08 298/23 C |
| 5,222,853 | A * | 6/1993 | Carson | 414/408 |
| 6,325,587 | B1 * | 12/2001 | Wysocki | B65F 1/004 220/909 |
| 6,752,583 | B2 | 6/2004 | Rajewski | |
| 8,033,774 | B2 | 10/2011 | Rajewski | |
| 2006/0219826 | A1 | 10/2006 | Yamamoto | |
| 2006/0219831 | A1 | 10/2006 | Yamamoto | |
| 2009/0045643 | A1 | 2/2009 | Roberto et al. | |
| 2009/0045644 | A1 | 2/2009 | Glass et al. | |
| 2009/0199933 | A1 | 8/2009 | Leitch | |
| 2010/0243778 | A1 * | 9/2010 | Yamamoto et al. | 241/186.4 |
| 2011/0240777 | A1 | 10/2011 | Johns et al. | |

(Continued)

OTHER PUBLICATIONS

AXO Collection Truck: found at http://ww.axo.cc/collection-vehicle-php?lang=en.

(Continued)

*Primary Examiner* — Saul Rodriguez
*Assistant Examiner* — Willie Berry, Jr.
(74) *Attorney, Agent, or Firm* — Foley & Lardner LLP

(57) ABSTRACT

A motor vehicle for collecting and sorting material includes at least one container disposed in a material-storage compartment of the motor vehicle, a bin tipper configured to receive a collection bin containing the material, and a hopper configured to receive the material from the collection bin and transport the material to a selected location in the material-storage compartment of the motor vehicle.

20 Claims, 17 Drawing Sheets

(56) References Cited

U.S. PATENT DOCUMENTS

| | | | |
|---|---|---|---|
| 2011/0240778 | A1 | 10/2011 | Yamamoto et al. |
| 2015/0098777 | A1 | 4/2015 | Rajewski et al. |

OTHER PUBLICATIONS

Shredfast Mobile Collection: found at- http://www.shredfast.com/mobile-collection/.
Shred-Tech Secure Collection Solutions; brochure.
UltraShred Transfer Trucks: found at- http://www.ultrashred.com/index.php/transfer-trucks.
Van Schijndel ACB500: found at- http://www.vanschijndelbv.nl/engels/acb500.html.

* cited by examiner

MOTOR VEHICLE FOR COLLECTING AND SORTING MATERIAL AND METHOD OF DOING SAME

CROSS-REFERENCE TO RELATED APPLICATIONS

This application claims the benefit under 35 U.S.C. §119 (e) of U.S. Provisional Application No. 61/616,979, filed on Mar. 28, 2012 the contents of which are hereby incorporated by reference in their entirety into the present disclosure.

BACKGROUND

Field of Embodiments

The disclosed embodiments relate generally to an apparatus and methods for loading and sorting material.

Description of Related Art

Material is often loaded into motor vehicles to be transported to other locations, for example, for delivery, recycling or destruction. A typical motor vehicle used to transport material includes a bin tipper and one common storage area. Typically, the bin tipper will lift a material-filled bin to a position over the top of the common storage area, and subsequently tip the bin such that the material falls out of the bin and into the storage area. The bin tipper can be single or double wide.

A problem encountered by conventional motor vehicles used to transport material is the inability to obtain a level load of the material across the entire storage area. The bin tipper may be disposed at one location the side, front, or back of the motor vehicle body and will repeatedly load material on the motor vehicle at that location in the storage areas. As a result, a pile of the material will be created at that location. Due to the steep angle of repose of the material, the pile tends to peak. When this is coupled with a limited bin dump height and limited overall body height, the volume of material that can be loaded into the vehicle body is limited. In addition, there is typically a lot of void space at or near the vehicle body walls.

In addition, conventional motor vehicles do not allow the operator to segregate materials. All the materials are mixed together in the storage area of the motor vehicle.

A need exists for improved technology, including technology that may address one or more of the above described disadvantages.

SUMMARY

One embodiment of the invention relates to a motor vehicle for collecting and sorting material. The motor vehicle includes at least one material-storage compartment of the motor vehicle, a bin tipper configured to receive a collection bin containing the material and a hopper configured to receive the material from the collection bin and transport the material to a selected location in the material-storage compartment of the motor vehicle. The material can be transported to a plurality of locations in the material storage compartment.

Another embodiment of the invention relates to a method for collecting and sorting material. The method includes receiving a collection bin containing the material, feeding the material, with a bin tipper, from the collection bin to a hopper, transporting the material to a selected location of at least two locations in a compartment of a motor vehicle such that the material may be sorted into at least two groups, and discharging the material from the hopper to the selected location.

BRIEF DESCRIPTION OF THE DRAWINGS

The disclosure will become more fully understood from the following detailed description, taken in conjunction with the accompanying figures, in which.

DETAILED DESCRIPTION

Figure 1:
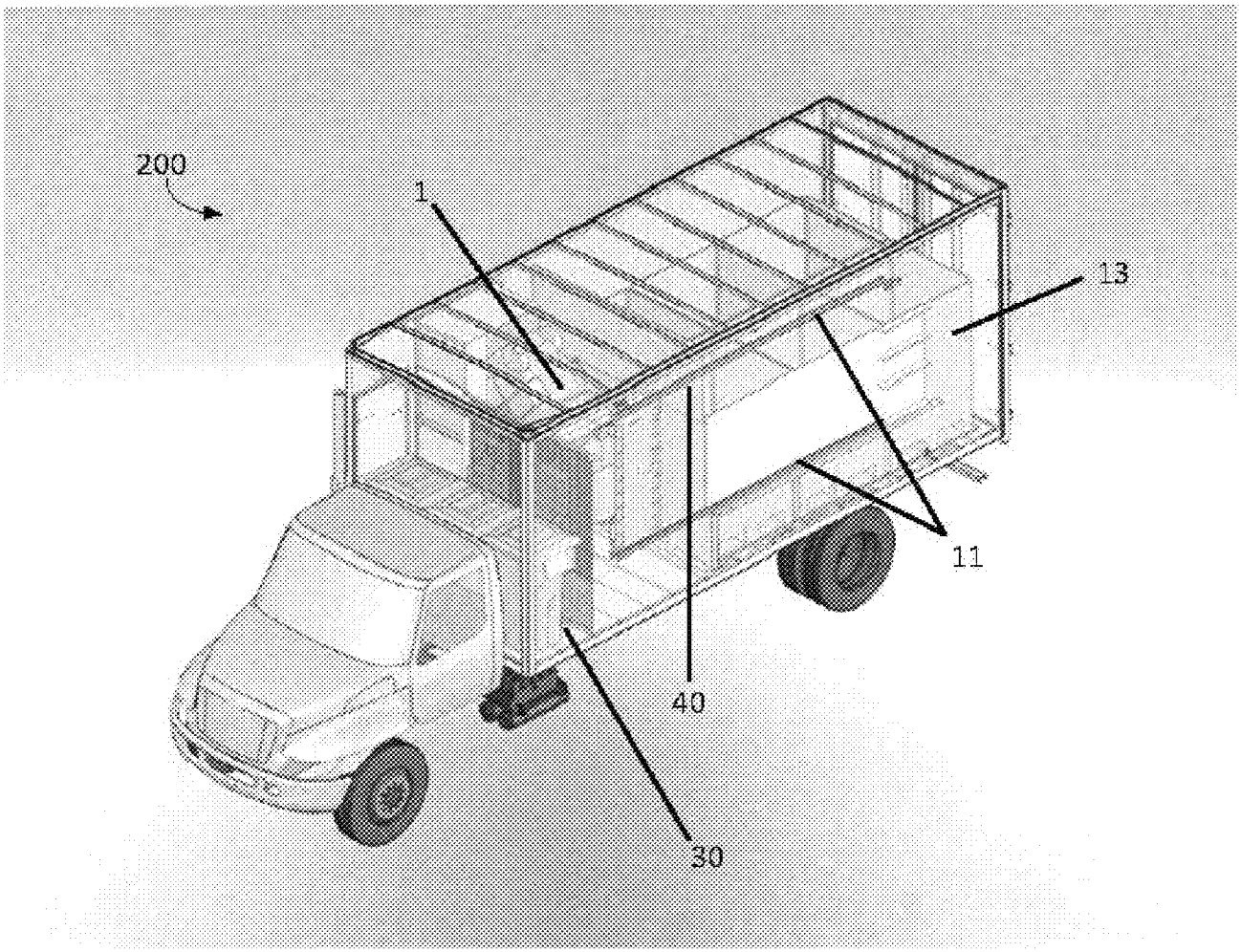
FIG. 1 is a perspective view of a transit loading apparatus of a motor vehicle.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting. Although the specification refers primarily to loading and sorting material in a motor vehicle, it should be understood that the subject matter described herein is applicable to being loaded and sorted in other environments, such as for example a warehouse or other worksite. The material to be loaded and sorted often will contain information and will be recyclable, but the invention can be applied to other materials that do not contain information and/or are not recyclable.

Overview of Motor Vehicle with Transit Loading Apparatus

FIGS. 1-18 illustrate embodiments of motor vehicle with a transit loading apparatus for loading and sorting material into a material-storage compartment in the motor vehicle. Examples of the materials that can be loaded and sorted include paper, uniforms, backup tapes, videos, credit cards, hard drives, e-scrap and compact discs. However, the material may be anything else that is capable of being loaded and sorted. In a preferred embodiment, the motor vehicle is used to transport the loaded and sorted material to a facility, such as a recycling or destruction facility.

In general, the transit loading apparatus can be configured to load material from, for example, ground level or dock level and distribute the material into the material-storage compartment and, more preferably, into several receiving containers in the material-storage compartment. More specifically, material may be collected from various sources and provided to the transit loading apparatus in any of a variety of collection bins, such as wheeled containers, carts or other bins. A bin tipper can be used to lift the conveyance device and load the material into a hopper of the transit loading apparatus. The hopper then moves to transfer the material to a pre-selected location or a pre-selected receiving container in the material-storage compartment. The hopper preferably is rotated to align with a container pre-selected by an operator, and the hopper empties the material at the location or into the receiving container, preferably through a moveable door of the hopper. Consequently, material can be loaded and sorted into one of a plurality of locations or containers in the material-storage compartment according to material type, quality or any other desired criteria.

Motor Vehicle

Preferably the motor vehicle 200 is a truck. However, other types of motor vehicles could be used. Moreover, the transit loading apparatus could find advantageous use in circumstances that do not involve the use of a motor vehicle. In one preferred embodiment, the motor vehicle 200 can be a side load collection truck (see FIGS. 2-3). However, other embodiments can be beneficially utilized, such as a rear load collection truck (not illustrated). This configuration allows the motor vehicle to accommodate facilities in which loading docks are used for loading materials.

Figure 18:
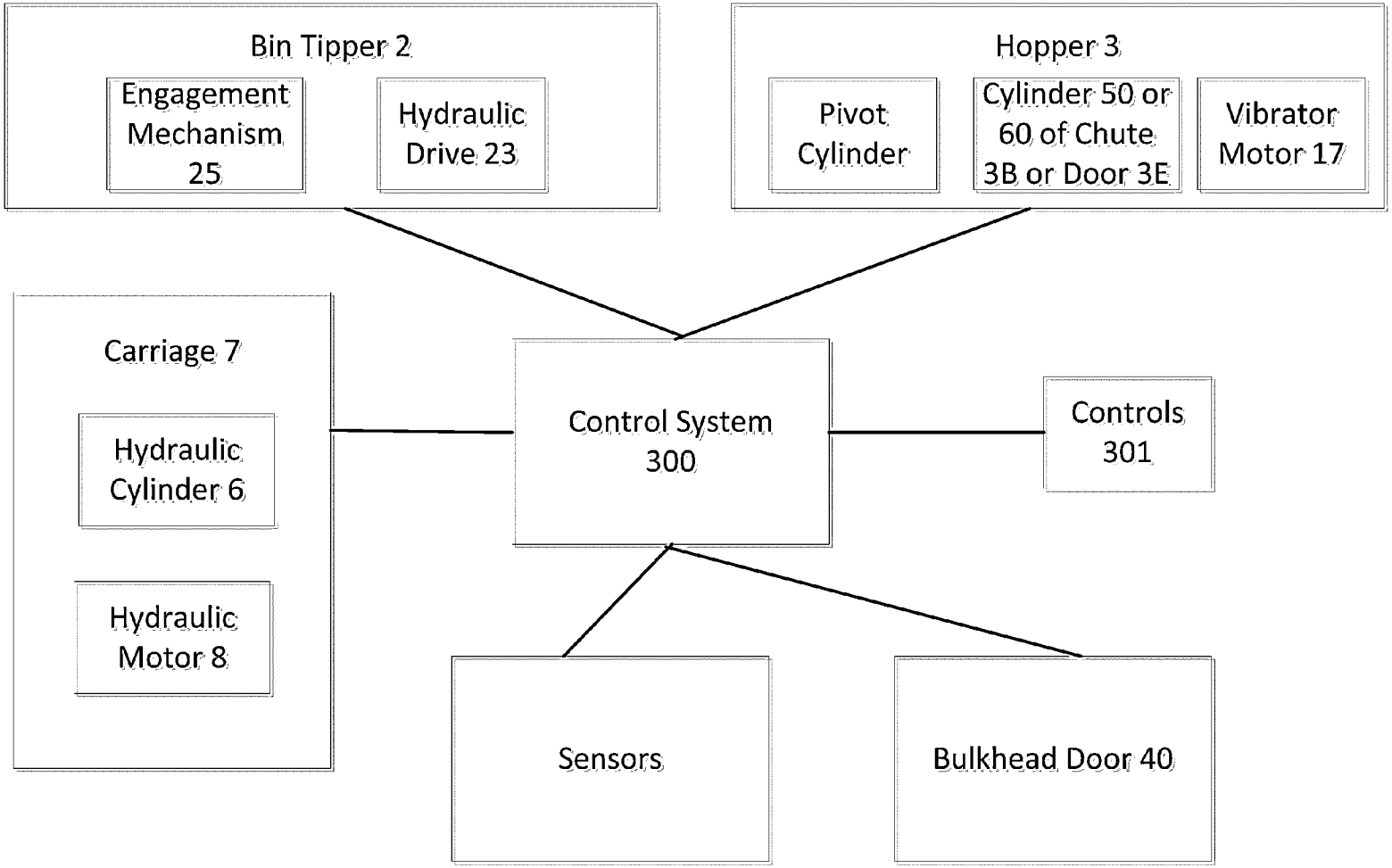
FIG. 18 is a block diagram of the control system of the transit loading apparatus of FIG. 1.

The motor vehicle 200 can include a control system 300 having at least one set of controls 301 that can be manipulated by an operator to control the system (see FIG. 18). The set of controls 301 may be located, for example, in a space 303 (see FIG. 2) at a side of the motor vehicle 200. In some embodiments, the motor vehicle 200 may include two sets of controls 301 for ground level and dock level control (not illustrated). This configuration allows an operator to safely and easily load the transit loading apparatus 100 while standing at either ground level or dock level. The motor vehicle 200 may also include cameras to enable operators to monitor loading and sorting operations.

More detailed aspects of preferred embodiments of the motor vehicle 200 are described below.

Storage Area

Figure 2:
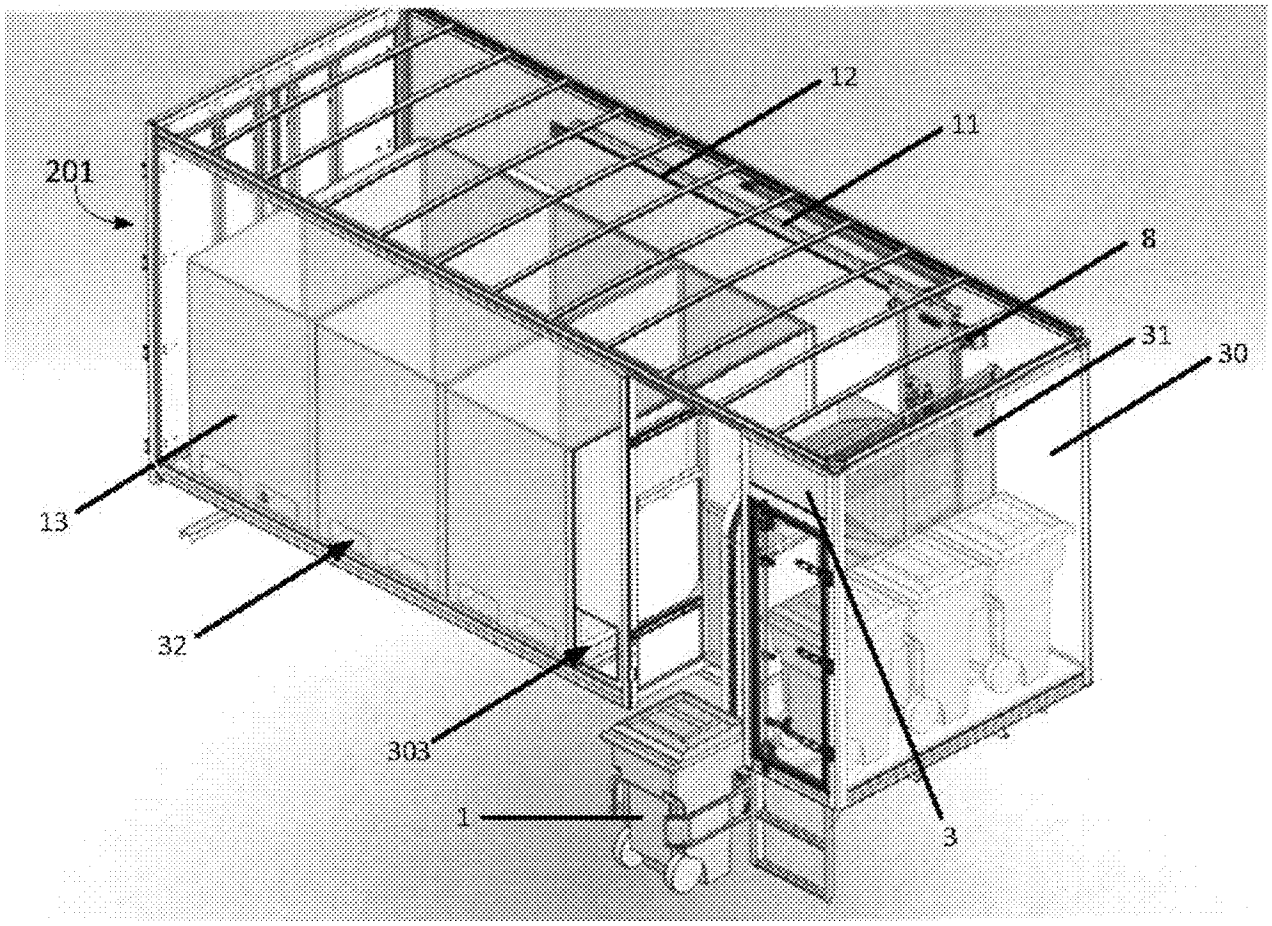
FIG. 2 is a perspective view of the transit loading apparatus of FIG. 1 at the start of the loading cycle.

The motor vehicle 200 may include a storage area 30 in the front of the motor vehicle body (see FIG. 2). The storage area 30 can be used to store a variety of items, such as carts or boxes. The storage area 30 also provides access to the area around the hopper 3 for maintenance. Storage area 30 preferably has an interlocked folding safety screen 31 (see FIG. 2) that is electronically interlocked to restrict access to the storage area 30 during operation of the transit loading apparatus 100. In one embodiment, the storage area 30 is large enough to contain three 96-gallon collection bins.

Bulkhead Door

For security purposes and to prevent egress of confidential materials while the motor vehicle 200 is in transit, the motor vehicle 200 may include a hydraulically actuated sliding bulkhead door 40 configured to seal off the storage area 30 when not in use (see FIG. 1). The bulkhead door 40 slides up and down via small hydraulic cylinders 41 (see FIG. 8). The movement of bulkhead door 40 can be fully automated and controlled by control system 300. When the transit loading apparatus 100 is powered-up, the bulkhead door 40 automatically opens. When the transit loading apparatus 100 is powered-down, the bulkhead door 40 automatically closes.

Material-Storage Compartment

As seen in the preferred embodiment of FIG. 2, the motor vehicle 200 may include a material-storage compartment 201 that is configured to receive and hold the material. Alternatively, the material-storage compartment 201 can be configured or to receive and hold containers 13, which have been loaded into the material-storage compartment 201, and which themselves are configured to receive and hold the material.

Figure 3:
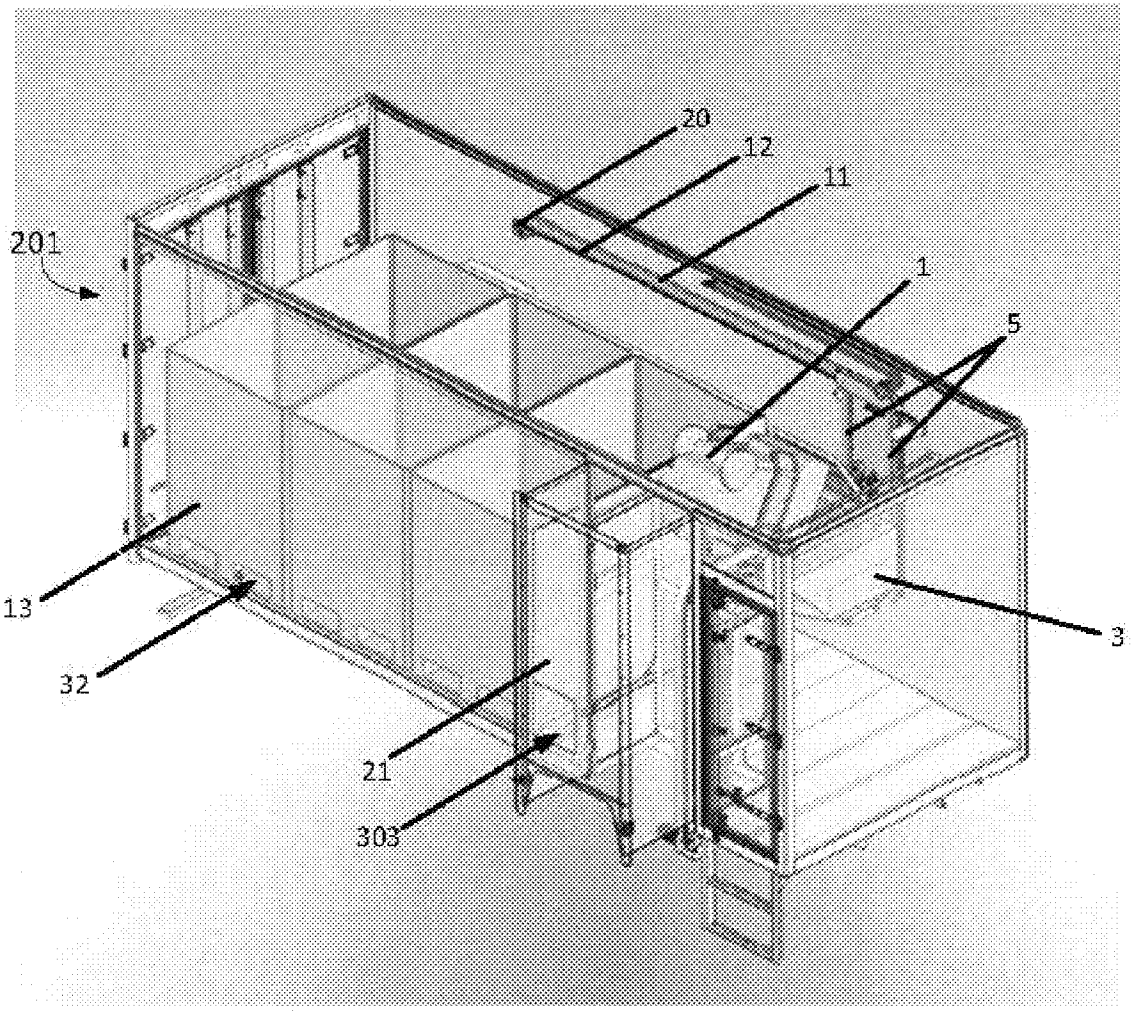
FIG. 3 is a perspective view of the transit loading apparatus of FIG. 1 when contents of a collection bin are being emptied into the hopper.

In a preferred embodiment, the containers 13 are located in the material-storage compartment 201 of the motor vehicle 200 (see FIGS. 2-3). The containers 13 may be arranged in the material-storage compartment 201 of the motor vehicle 200 in one or more rows. For example, the containers 13 may be arranged in two rows—a first row aligned with a driver side of the motor vehicle 200 and a second row aligned with a passenger side of the motor vehicle 200. In the embodiment illustrated in FIGS. 2-3, there are six containers 13, however, the transit loading apparatus 100 is not limited to six containers 13 as shown. Alternative embodiments can include additional containers or containers of varying sizes.

The containers 13 may be any predefined size, for example, 450 gallon bins. Preferably, the transit loading apparatus includes containers 13 that fit standard lifting/tipping mechanisms for material feed in in-plant shredding systems.

In one embodiment, the containers 13 are restrained in the material-storage compartment 201 in a tight (i.e., no gaps between adjacent containers 13) and predetermined configuration. This ensures that the material is emptied in the desired spot and no material falls between containers. In another embodiment, a part containerized, part bulk loading configuration can be used where, for example, a small quantity of a particular material is collected in a container 13, while the remaining materials are emptied onto the floor of the material-storage compartment 201.

With the inclusion of a plurality of containers 13, the transit loading apparatus 100 can minimize the negative effects of material angle of repose on fill capacity. In addition, the transit loading apparatus 100 has the ability to segregate different types of material. The ability to fill each of the containers 13 containers independently, provides a great deal of flexibility in the type and quantity of materials collected.

After the motor vehicle 200 arrives at its destination, the containers 13 can be unloaded by forklift removal. The containers 13 can include two openings 32 disposed near the bottom of each of the four side faces of the containers 13. The two openings 32 are disposed beneath a floor of the containers 13 to prevent egress of the material from containers 13. The two openings 32 are configured to receive two forks of a conventional forklift.

In another embodiment, the containers 13 can be moved to the back of the motor vehicle 200 by a moving floor system. A conventional moving floor, as is known in the industry, could be disposed on the floor of the material-storage compartment 201 of the motor vehicle 200.

Transit Loading Apparatus

Figure 4:
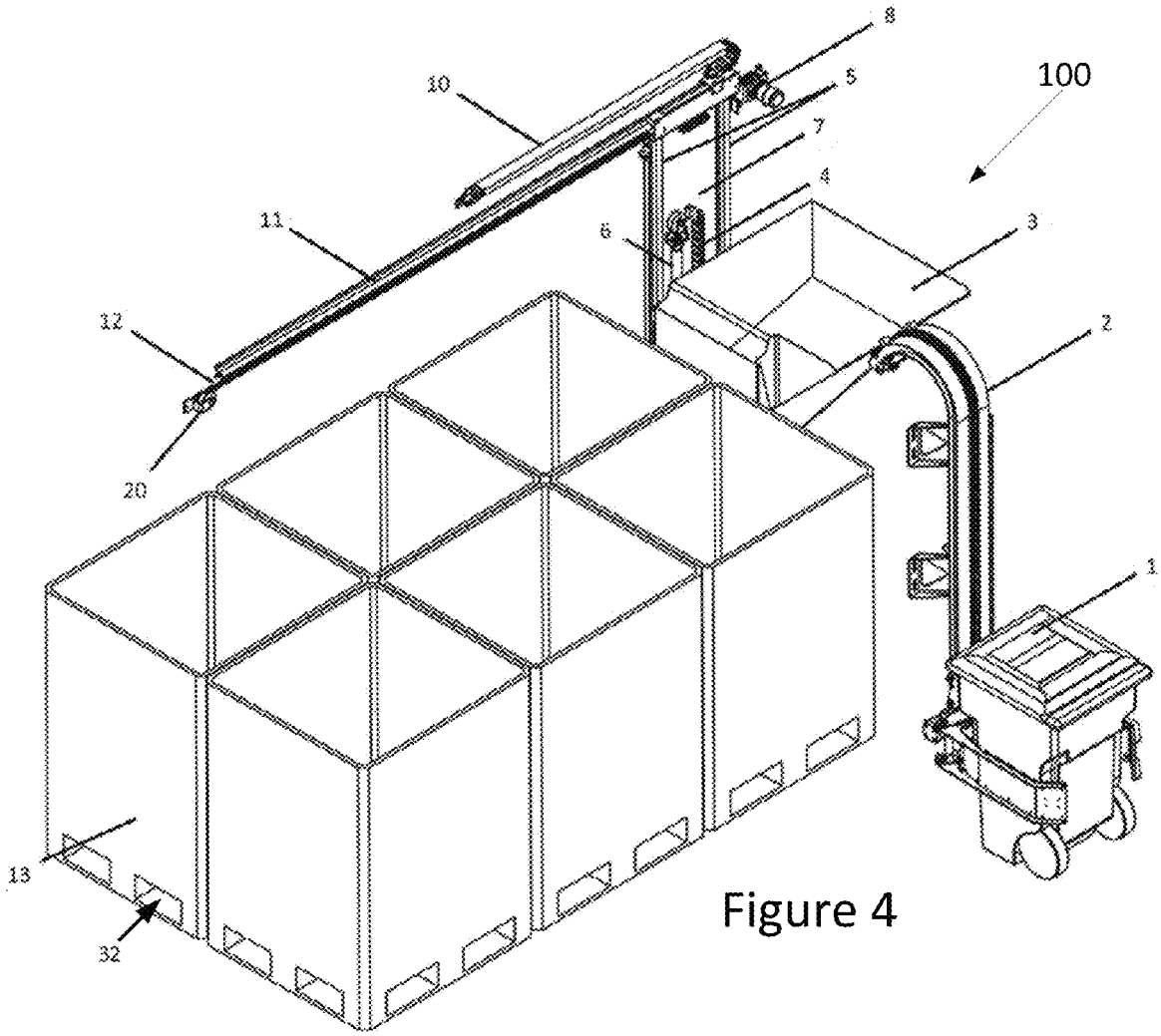
FIG. 4 is a perspective view of the transit loading apparatus of FIG. 1 including a bin tipper, a hopper and a plurality of containers.
Figure 5:
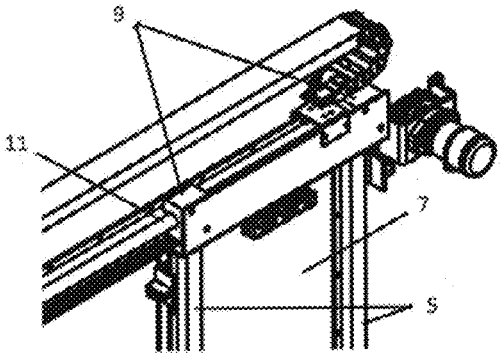
FIG. 5 is a perspective view of a hopper guidance system for the hopper of FIG. 4.

As shown in FIG. 4, the transit loading apparatus 100 may include a bin tipper 2 and a hopper 3. The transit loading apparatus 100 is configured to receive a collection bin 1 containing the material to be loaded and sorted. The bin tipper 2 can empty the material to be loaded and sorted into the hopper 3. The hopper 3 can transport the material into one of a plurality of containers 13. The plurality of containers 13 can receive the material, allowing an operator to segregate different types of material into each of the plurality of containers 13.

Bin Tipper

Bin tipper 2 is configured to load material into the hopper 3. In particular, the bin tipper 2 receives the collection bin 1, lifts the collection bin 1, and empties the contents of the collection bin 1 into the hopper 3 (see FIG. 3). In one embodiment, the bin tipper 2 is configured to engage with the collection bin 1 at a side of a motor vehicle 200 (e.g., a side load collection truck). In another embodiment, the bin tipper 2 is configured to engage with the collection bin 1 at a rear of the motor vehicle (e.g., a rear load collection truck).

The bin tipper 2 may be housed in a bin tunnel 21 (see FIG. 3) for safety and security reasons. The bin tunnel 21 is configured to prevent the collected material from being exposed to wind and to prevent the operator from being caught by a collection bin 1 during raising or lowering of the same. The bin tipper 2 and the bin tunnel 21 can be constructed in a conventional manner. The components and configuration thereof of a preferred bin tipper 2 and bin tunnel 21 are described in U.S. Pat. No. 6,588,691, the entire contents of which are hereby incorporated herein by reference.

Figure 7:
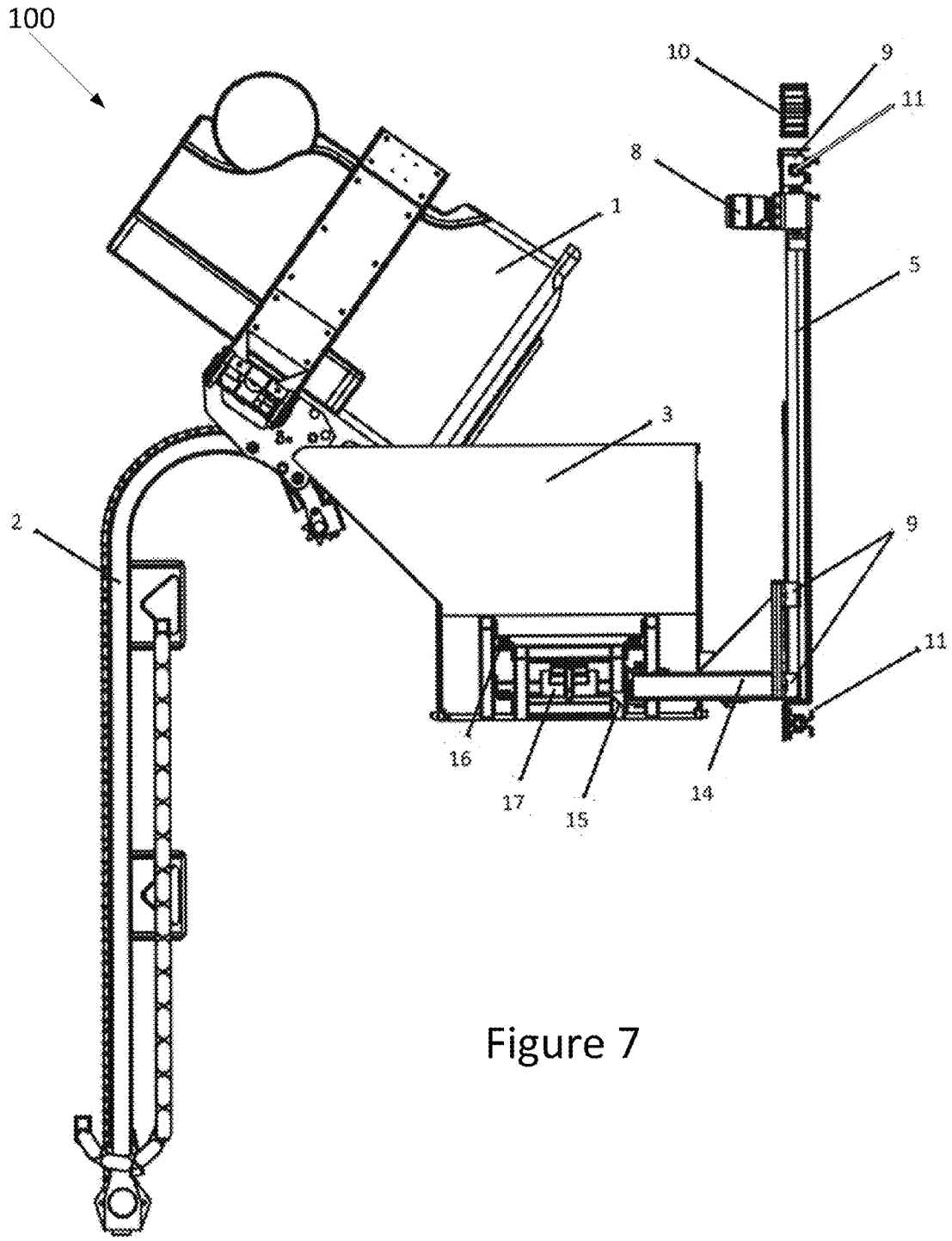
FIG. 7 is a side view of the bin tipper and hopper of FIGS. 6A-6C.
Figure 8:
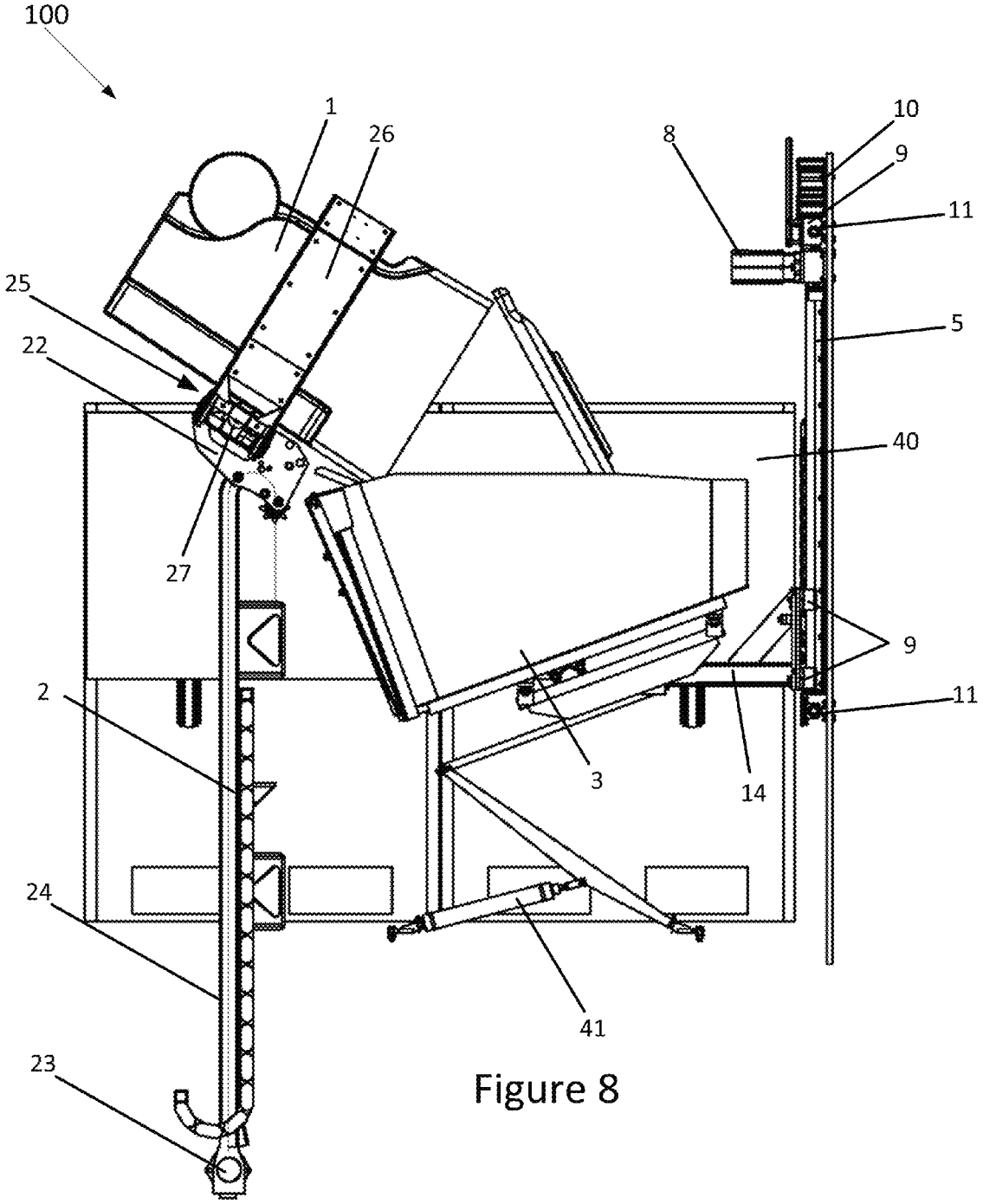
FIG. 8 is a side view of a second embodiment of the bin tipper and the hopper of FIG. 4.
Figure 9:
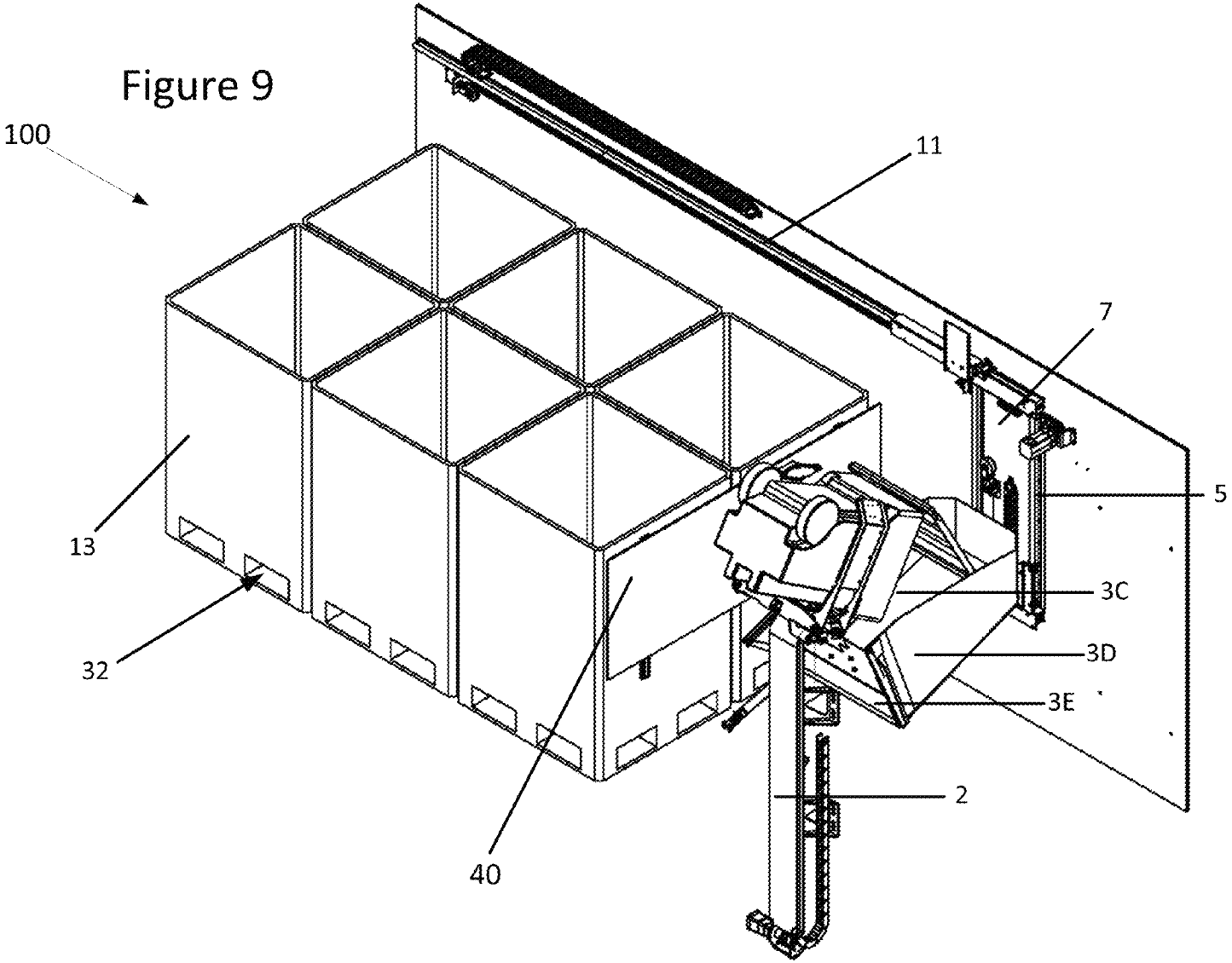
FIG. 9 is a perspective view of the transit loading apparatus of FIG. 8 when the bin tipper feeds its contents to the hopper.
Figure 10:
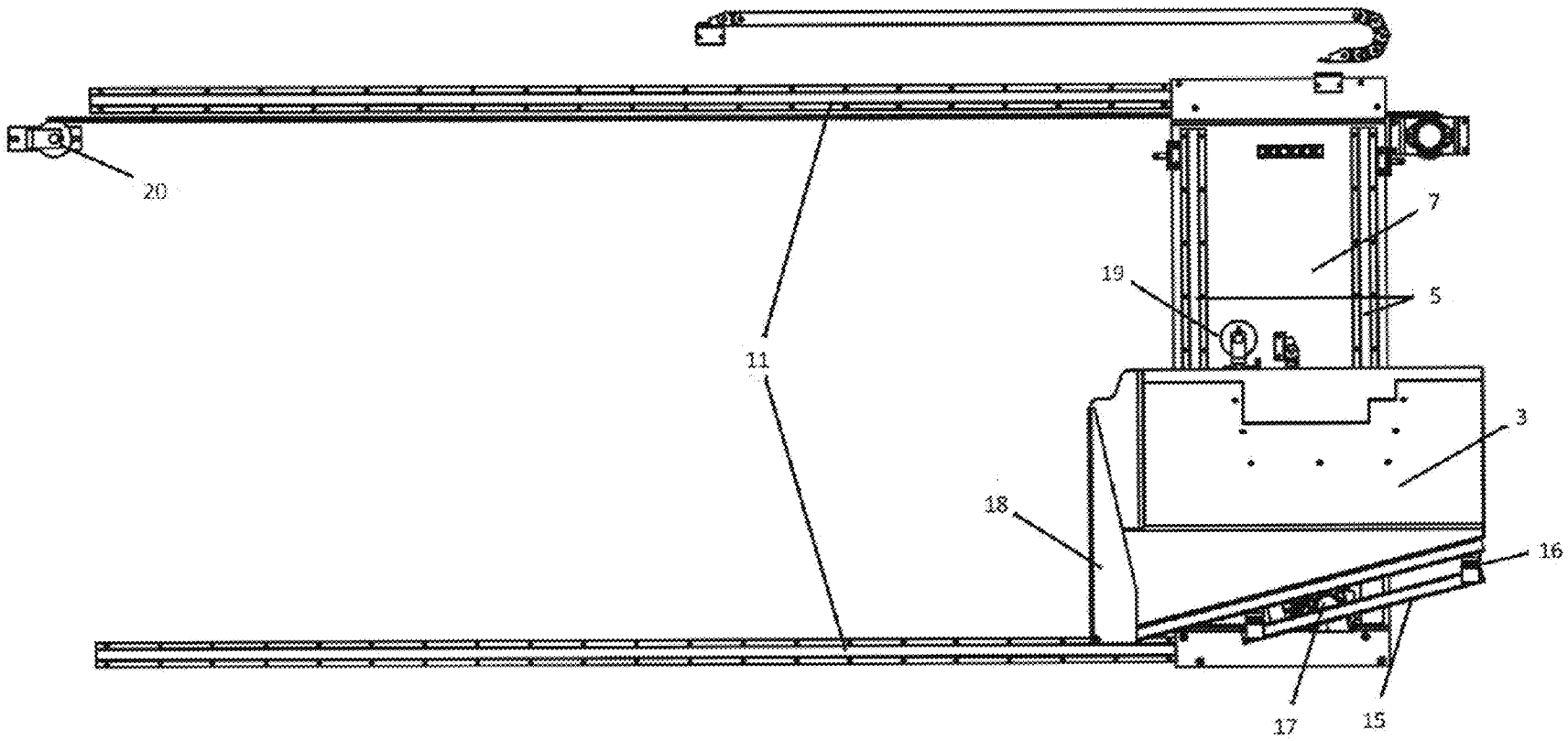
FIG. 10 is a front view of a hopper guidance system for the hopper of FIG. 4.
Figure 11:
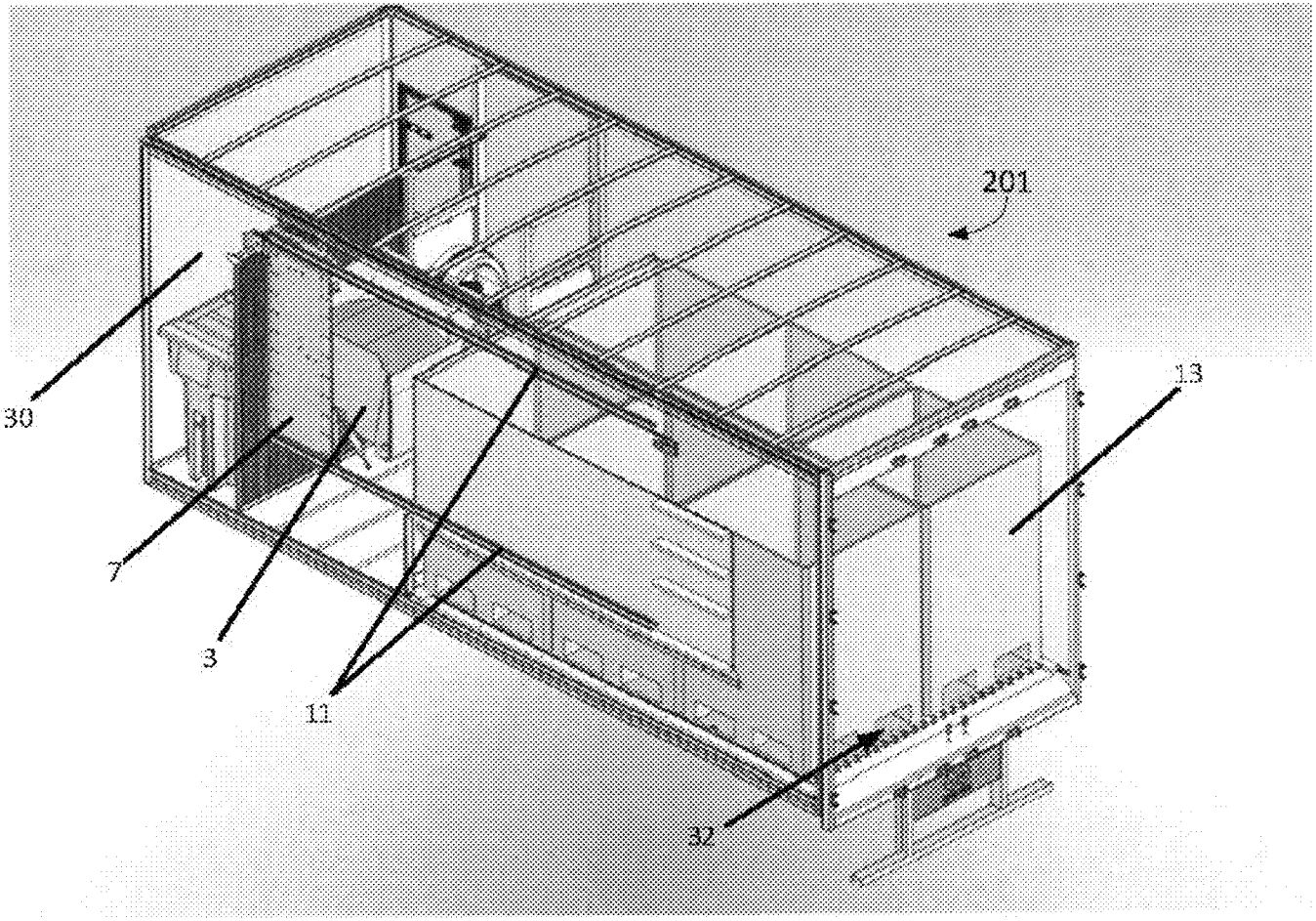
FIG. 11 is a perspective view of the rear of the transit loading apparatus of FIG. 1.
Figure 12:
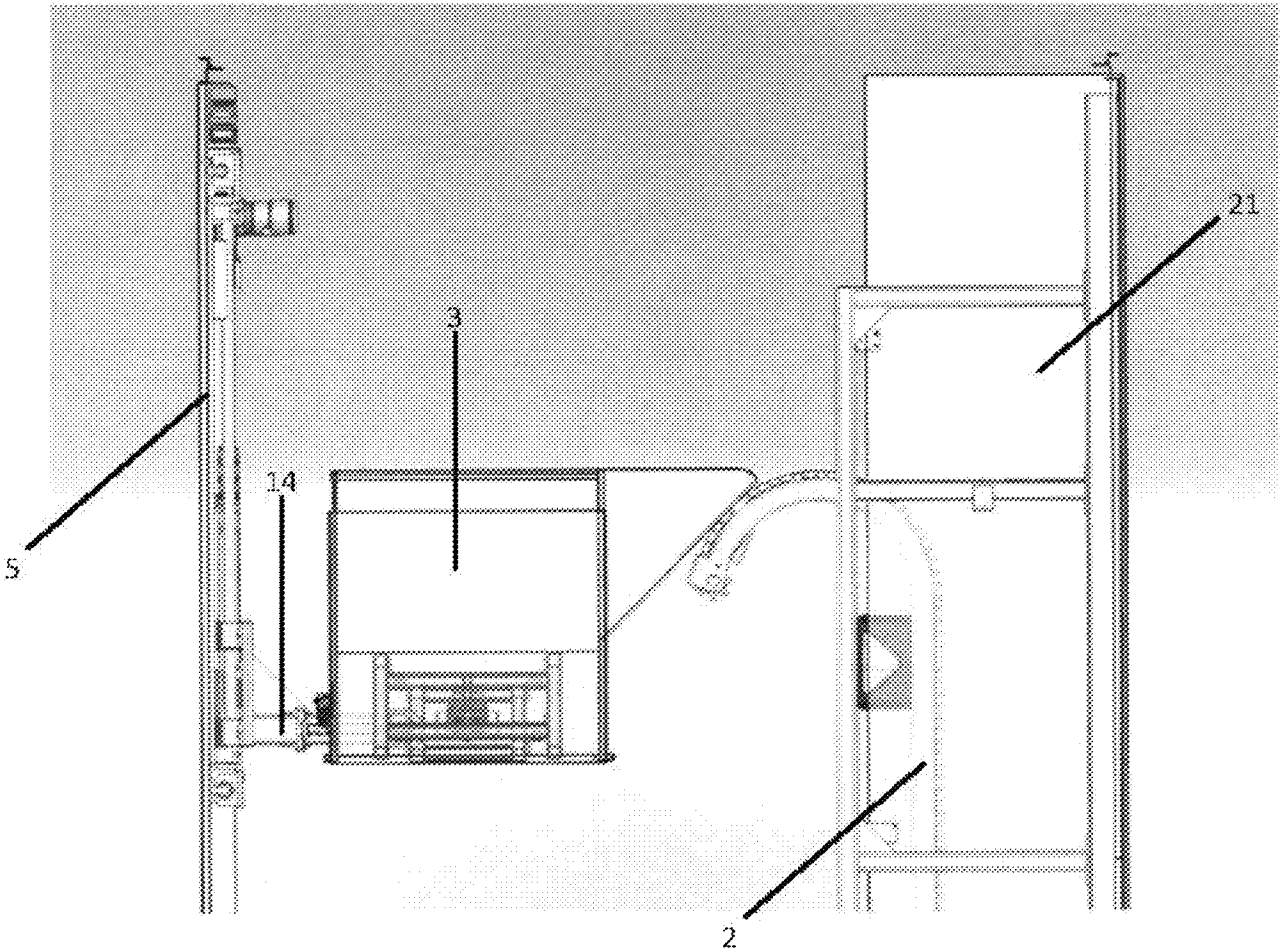
FIG. 12 is a side view of the hopper of FIG. 4 in a resting position.
Figure 13:
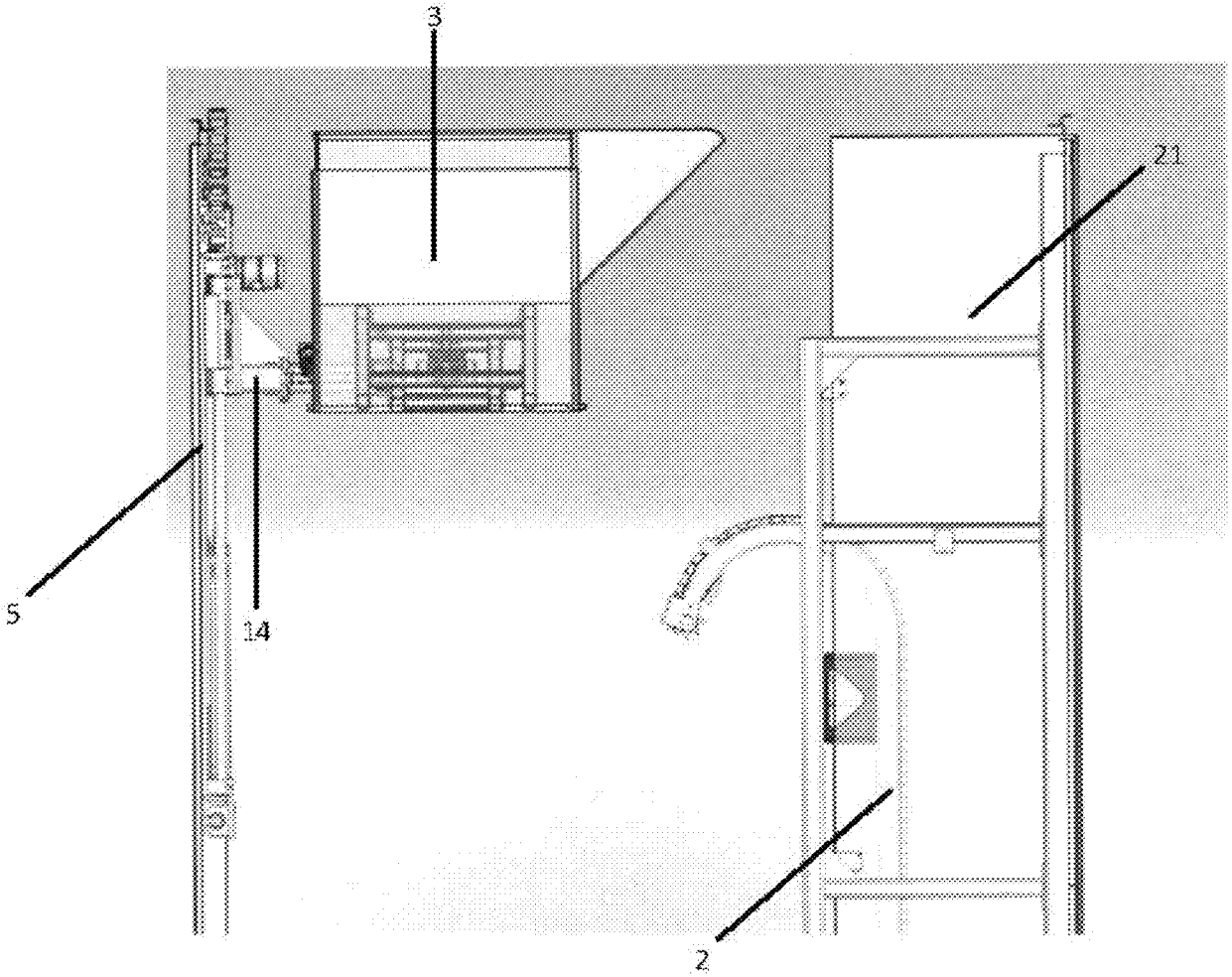
FIG. 13 is a side view of the hopper of FIG. 4 at a transfer height.

Referring to FIGS. 4, 7 and 8, bin tipper 2 may include a carriage 22 and a hydraulic drive 23 for powering a chain 24. The carriage 22 is mounted onto the chain 24. The carriage 22 has an engagement mechanism 25 for attaching the collection bin 1. In one embodiment, the engagement mechanism 25 may include two arms 26, each of the arms 26 configured to close in a direction toward the other arm 26 to grip the collection bin 1. The arms 26 may be pivotally mounted. Each of the arms 26 may be connected to a cylinder 27 configured to actuate the arm 26. The chain 24 is moveable by means of the hydraulic drive 23 from a lower position, in which the carriage is adjacent to the ground on which a motor vehicle 200 is standing, up and over an arc to a raised position, in which the carriage 22 is adjacent to an inlet of the hopper 3. The contents of the collection bin 1 are fed into the hopper 3 via a top of the hopper 3.

Hopper

Figure 14:
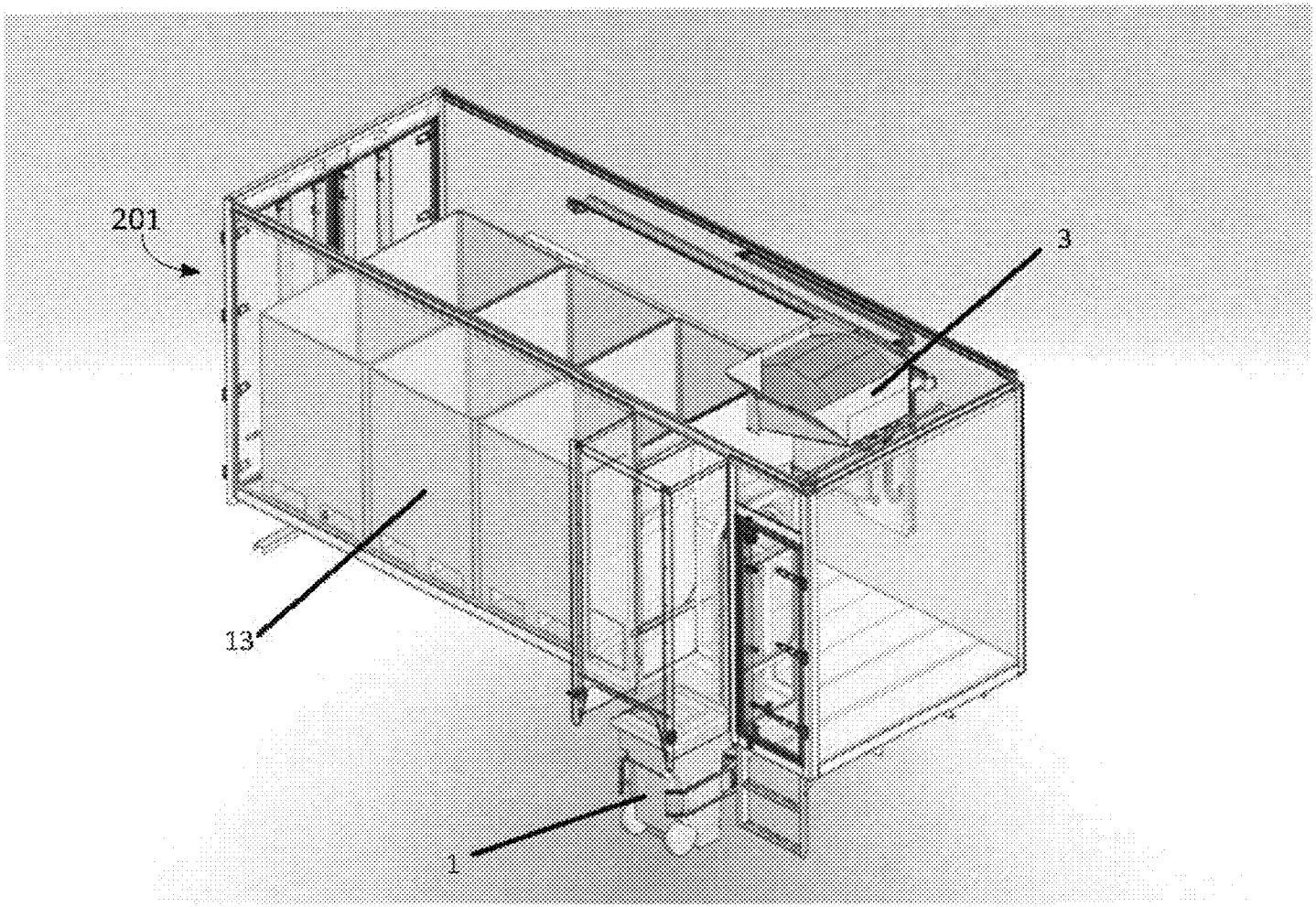
FIG. 14 is a perspective view of the transit loading apparatus of FIG. 1 when the hopper is translated vertically.
Figure 15:
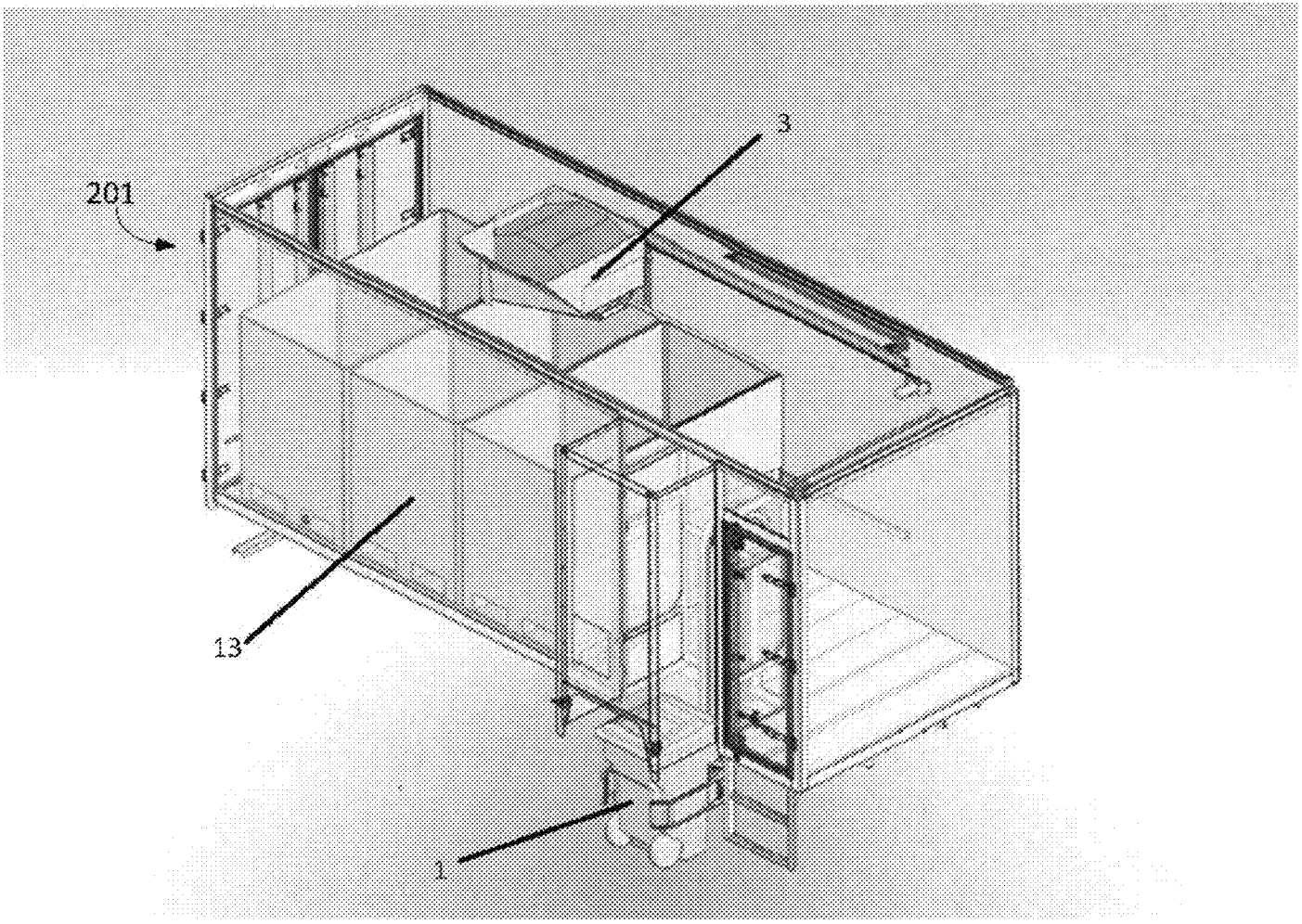
FIG. 15 is a perspective view of the transit loading apparatus of FIG. 1 when the hopper is translated horizontally.
Figure 16:
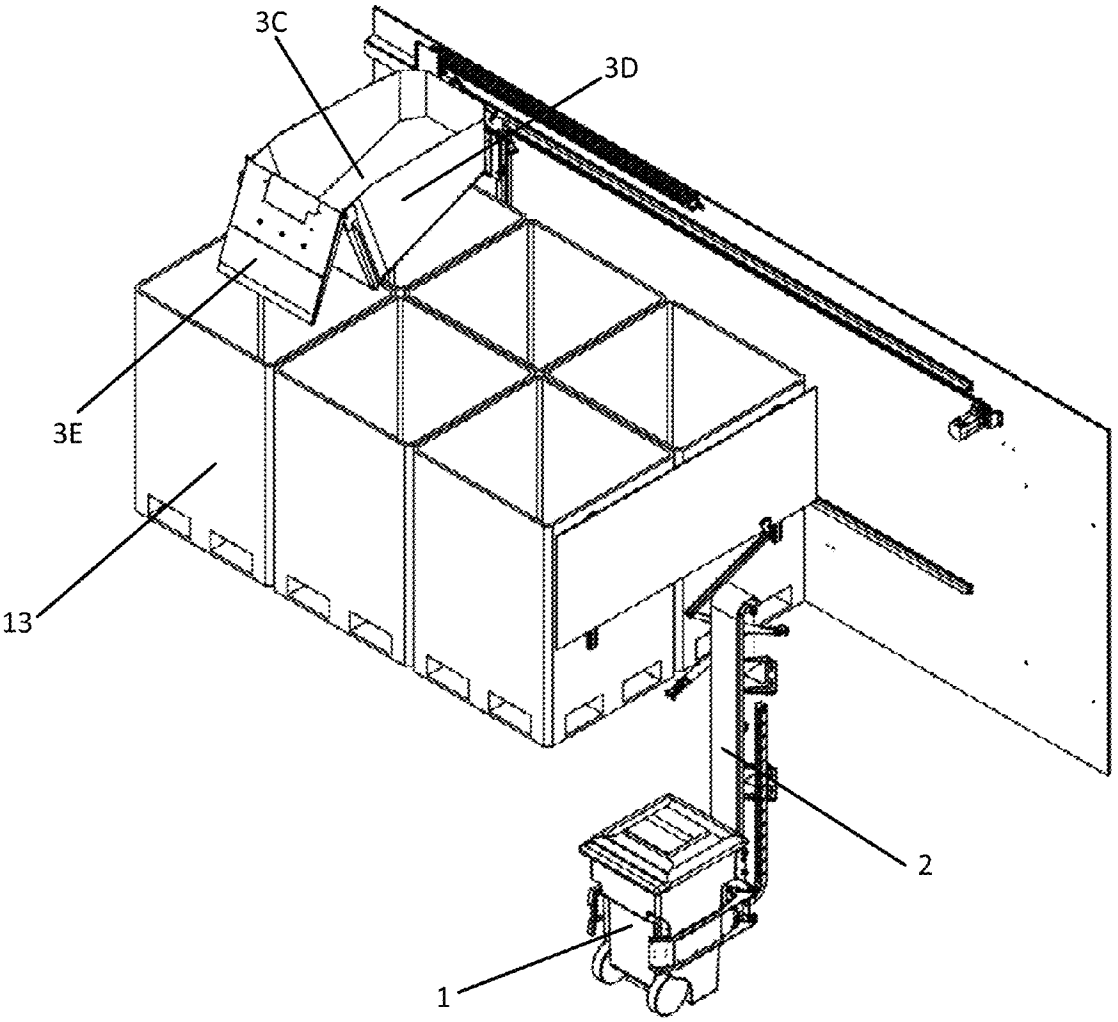
FIG. 16 is a perspective view of the transit loading apparatus of FIG. 8 when the hopper empties its contents into a pre-selected container of the plurality of containers.
Figure 17:
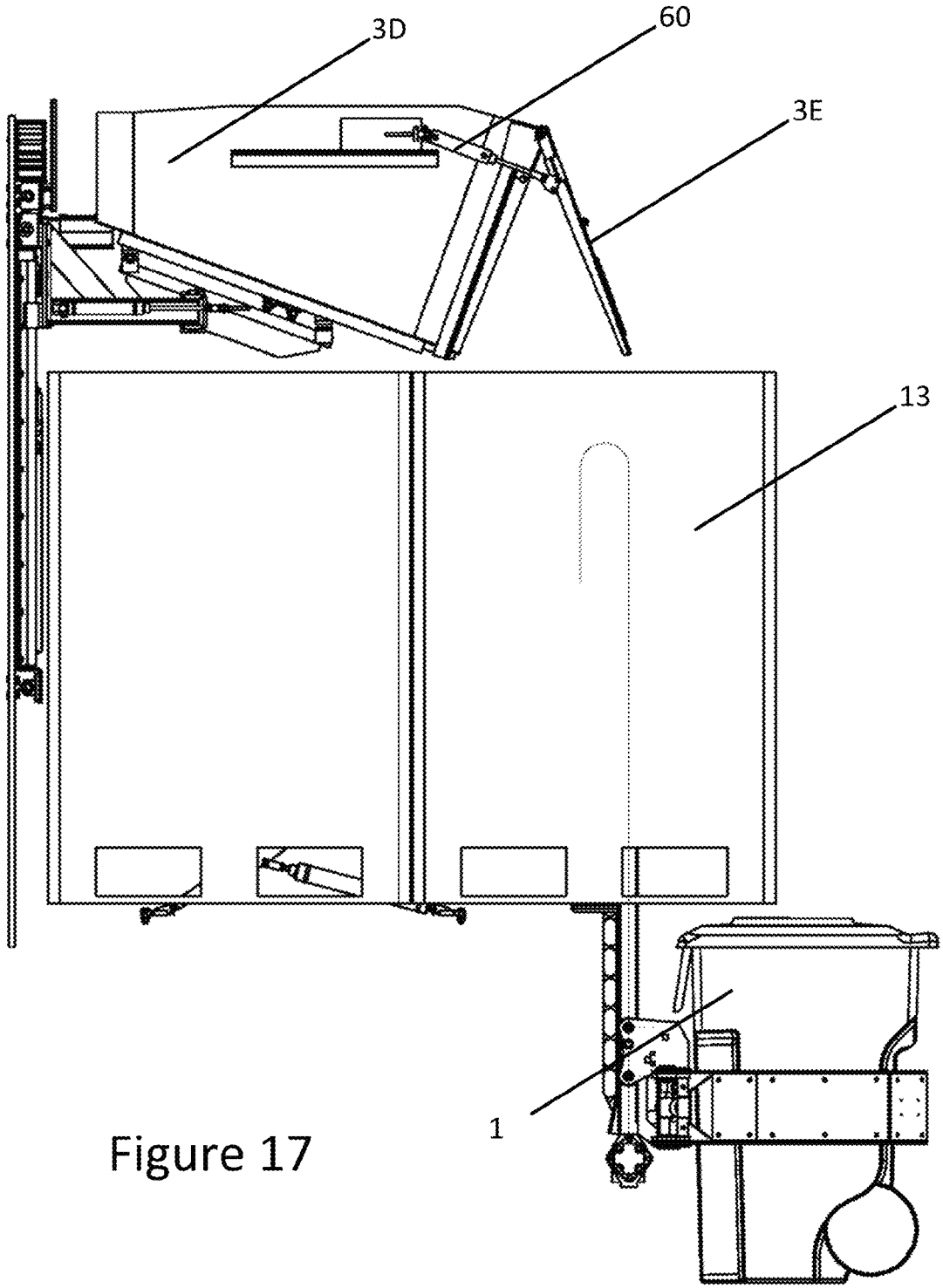
FIG. 17 is a side view of the transit loading apparatus of FIG. 8 when the hopper empties its contents into a pre-selected container of the plurality of containers.

The hopper 3 is configured to load the material into a desired location in the material-storage compartment 201, such as within a specific container 13 in the material-storage compartment 201. The hopper 3 can be mounted on a hopper mounting frame 15, which is rotatably connected to a hopper mount 14. Hopper mount 14 is supported by four linear bearings 9, which are mounted to two vertical rails 5, which guide the hopper 3 in a vertical direction. As seen in FIGS. 14 and 19, the hopper 3 has a resting position adjacent to the arc of the bin tipper 2.

In a first embodiment, illustrated in FIGS. 6A-6C and 7, the hopper 3 enclosure includes a sloping side wall 3A configured to assist in loading collected material, a chute 3B pivot mounted to a bottom edge of the hopper 3 and a sloped bottom wall 3C. A top of the hopper 3 may remain uncovered (i.e., no lid). The chute 3B forms part of the hopper 3 enclosure (i.e., a side wall of the hopper 3). The chute 3B is configured to open to a downward declining position such that the chute 3B has a same slope as the bottom wall 3C of the hopper 3 in order to discharge the collected material into a selected location, for example, a selected container 13. In other words, in the first embodiment, the collected material is loaded into a top of the hopper 3 and discharged from a side of the hopper 3 via the chute 3B that opens in a downward declining position. The hopper 3 may be configured to rotate up to 45° in a single direction about a vertical axis perpendicular to the hopper mount 14. Specifically, the hopper mount 14 moves up and down on the vertical rails 5 mounted on a carriage 7 (the carriage 7 is illustrated, for example, in FIG. 4). An end of the hopper mount 14 includes a pivot pin configured to serve as a mount for the hopper 3. The hopper 3 pivots about the pivot pin of the hopper mount 14.

In a second embodiment, illustrated in FIGS. 8, 9, 16 and 17, the hopper 3 enclosure includes side walls 3D disposed perpendicular to a sloped bottom wall 3C and a pivotally mounted door 3E. In one embodiment, the door 3E forms part of the hopper 3 enclosure (i.e., a front wall of the hopper 3) and is pivotally mounted to a top edge of the hopper 3. The hopper 3 may be slightly wider in the front of the enclosure as compared to a width of a back of the enclosure. The door 3E is configured to open to an upward position when material is being discharged from the hopper 3 to the selected location, for example, a selected container 13. In other words, in the second embodiment, the collected materials is loaded and discharged from a front of the hopper 3 via the door 3E that opens to an upward position.

In the second embodiment, the hopper 3 does not include a chute 3B that extends from the hopper, the hopper 3 may have a wider range of rotation in order to access each of the plurality of containers 13. For example, the hopper 3 may be configured to rotate up to 93° in a single direction about a vertical axis perpendicular to the hopper mount 14. In such a configuration, if the hopper 3 is not rotated, the hopper 3 may only discharge material into containers 13 arranged on the passenger side of the motor vehicle 200. If the hopper 3 is rotated approximately 93°, the hopper 3 may discharge material into containers 13 arranged on the driver side of the motor vehicle. In addition, in the second embodiment, when the hopper 3 is moved about the material-storage compartment 201 of the motor vehicle 200, a lower leading edge of the hopper 3 is located just above the plurality of containers 13 since the configuration does not include the chute 3B. Thus, the second embodiment minimizes the vertical height and space requirements of the hopper 3.

In both the first and second embodiments, the hopper frame 15 can be vibration isolated from hopper 3 by a rubber mount (not illustrated). A vibrating motor 17 is mounted to the bottom of hopper 3 and is configured to provide force excitation to aid material discharge.

Operation of the Transit Loading Apparatus

Referring now to FIGS. 4 and 8-17, in operation of the transit loading apparatus 100, the bin tipper 2 receives and engages with the collection bin 1 via the engagement mechanism 25, lifts the collection bin 1 via the carriage 22 and the chain 24, and empties the contents of the collection bin 1 into the hopper 3. Once the empty collection bin 1 is retracted at a sufficient distance at the top of the bin tipper 2, to clear the hopper 3, the transit loading apparatus can begin motion to transport the material to one of the plurality of containers 13. The material is transitioned via vertical, horizontal and pivoting sequences. Hydraulic cylinder 6 (FIG. 4) has an idler mounted at the end of a rod and is attached to carriage 7 at the other end. A chain, not illustrated in the figures, is attached to carriage 7 at one end, extends vertically to wrap the idler for 180 degrees and extends down vertically to be anchored to the hopper mount 14. Extension and retraction of the hydraulic cylinder 6 causes the hopper mount 14, with hopper 3 attached, to lift and fall.

A hose and cable carrier 4 houses all hydraulic hoses, electrical wire and sensor wires for vertical motion. Vertical bars 5, which support the hopper 3, are affixed to carriage 7. Carriage 7 is supported by the four linear bearings 9, which are mounted to two horizontal rails 11 (see FIG. 5). Once the empty collection bin 1 is retracted at a sufficient distance at the top of the bin tipper 2, the hopper 3 is raised to a transfer height (see FIG. 13). At the transfer height, the hopper 3 can be moved laterally to the location of the pre-selected container 13 and rotated as needed.

An operator can pre-select a container 13 using control system 300 (described in detail below). The process of emptying the hopper 3 can be automated. As illustrated in FIGS. 1, 4, 11 and 17, the horizontal rails 11 guide carriage 7, with hopper 3 attached, in the horizontal direction. A chain 12 wraps the idler of a tensioner 20 and the sprocket mounted on an output shaft of a hydraulic motor 8 with both chain ends on a lower strand of a chain attached to carriage 7. Activation of the motor 8 produces bidirectional horizontal motion of the carriage 7 and the attached hopper 3. A hose and cable carrier 10 houses all hydraulic hoses, electrical wire and sensor wires for horizontal motion.

The vertical and horizontal rails and bearing elements ensure a smooth transfer and a jerk free movement.

Figure 6B:
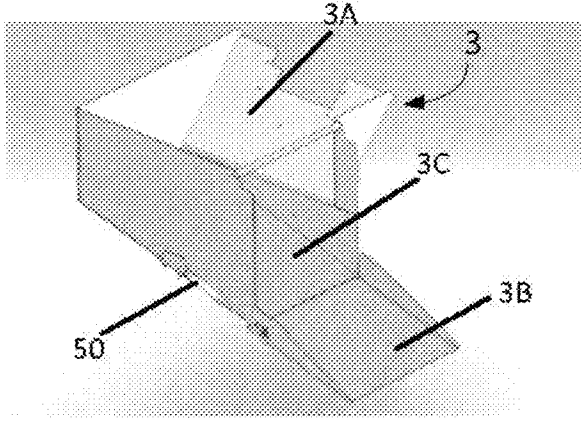
FIGS. 6A-6C are different views of a first embodiment of the hopper of FIG. 4.
Figure 6A:
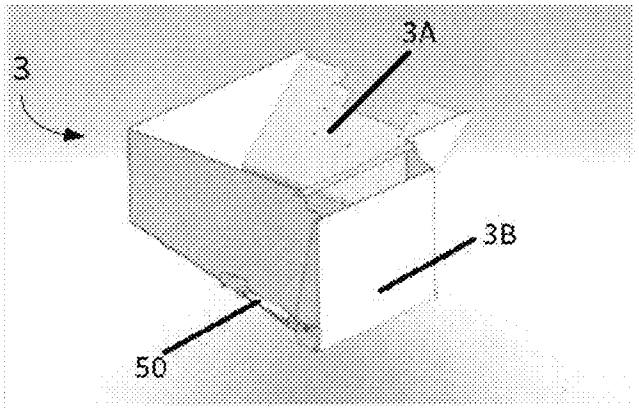
Figure 6C:
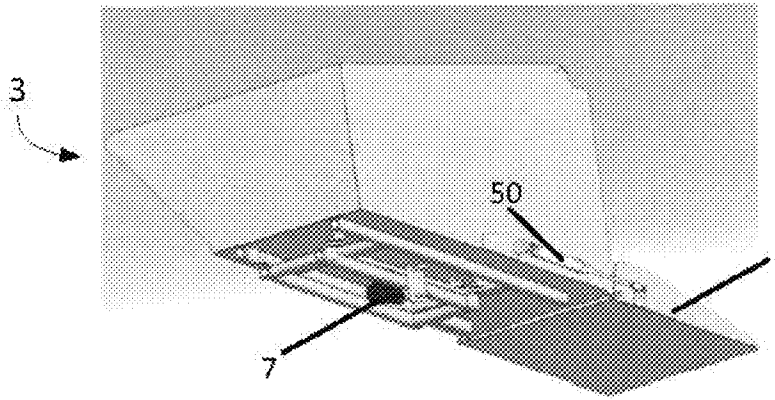

In the first embodiment of the hopper 3, once the hopper 3 reaches the location of the pre-selected container 13 (see FIGS. 15-17), an actuation cylinder 50 (see FIG. 6A-6C), rotates the chute 3B to a downward declining position to slide material out of the hopper 3 (see FIG. 6C). In the second embodiment of the hopper 3, once the hopper 3 reaches the location of the pre-selected container 13 (see FIGS. 16-17), an actuation cylinder 60 rotates the door 3E to an upward position and material is discharged from the door 3E by virtue of the sloped bottom wall 3C. After the hopper 3 is emptied, the hopper 3 will return to the resting position in a reverse sequence.

A sensor, not illustrated in the figures, is located under the hopper at the resting position where hopper 3 is positioned to receive material from bin tipper 2. When hopper 3 is in transit away from the resting location, bin tipper 2 is permitted to operate. However, bin tipper 2 will pause and wait at the top of the bin tipper travel (e.g. at the arc) until hopper 3 has returned to the resting position.

Power

In one embodiment, the transit loading apparatus 100 is driven using traditional hydraulic technology through a power take-off (PTO) mounted on the truck transmission, a technique typical of the industry. In another embodiment, the system could be powered using electrical power as outlined in U.S. Patent Application No. 2011/0240777, the entire contents of which is hereby incorporated by reference. Using electrical power provides advantages such as reduced fuel usage and environmental impact on the environment, use of a high percentage of grid energy for operation, operation without the engine idling, and the ability to operate inside buildings without the concern of releasing toxins in the air.

Alternatively, since the overall power requirements of the transit loading apparatus 100 are vey low, a small auxiliary engine power unit, either electric or hydraulic, could be used for power. This would allow for segregation of fuel usage.

Control System

Referring to FIG. 18, the control system 300 can be used to control the individual components of the transit loading apparatus 100. For example, the control system can control the bin tipper 2, the hopper 3 and the bulkhead door 40. The individual components of the transit loading apparatus 100 that can be controlled by the control system 300 are not limited to the individual components mentioned above. The control system 300 includes a set of controls 301. The set of controls 301 may be located, for example, in the space 303 (see FIG. 2) at a side of the motor vehicle 200. The control system 300 may be any known computing system but is preferably a programmable, processor-based system. The control system 300 can include a microprocessor having a permanent memory for storing software for the operation and monitoring of the transit loading apparatus 100 and a reprogrammable memory for storing storage data and system variables. For example, the control system 300 may include a microprocessor, a hard drive, solid state memory, random access memory (RAM), read only memory (ROM), input/output (I/O) circuitry, and any other well-known computer component. The software can comprise the procedures, algorithms and all other operation parameters and protocols for controlling the individual components of the transit loading apparatus 100. Almost any microprocessor could execute the algorithms, and the software language could be assembly code, C, C#, BASIC, or the like.

The operator can view the load in each container 13 via digital cameras and a video screen on the control system 300 to determine the level of fill and to select the container 13 to receive contents of the hopper 3. Thus, the operator is provided with the opportunity to optimize the fill of the vehicle. The desired location for the hopper 3 is selected manually by the operator via the control system screen and buttons, not illustrated in the figures. The system is programmed such that it will move the hopper 3 to selected location and empty the contents of the hopper 3 in the selected container 13 without further interruption from the operator.

Alternative Embodiments

While the invention is particularly advantageous with the use of containers, advantages also could be realized without the use of containers. For example, there may be only one large receptacle and the hopper 3 could be used to distribute the material within the one receptacle. In such an embodiment, the hopper 3 can empty the material on the floor with no containers 13. In this case, the operator should select the available dumping location in a sequential manner to ensure uniform material distribution of the material and ensure that the material remains at a lower level than the hopper 3 of the transit loading apparatus 100. Sequential distribution will also ensure that the rear of the motor vehicle 200 is not overloaded.

In other embodiments, the movement of the hopper 3 can be varied. For example, the hopper 3 could follow transitional movements instead of pivoting.

One versed in the art would appreciate that there may be other embodiments and modifications within the scope and spirit of the disclosure. Accordingly, all modifications attainable by one versed in the art from the present disclosure, within its scope and spirit, are to be included as further embodiments of the present disclosure.

What is claimed:

1. A motor vehicle for collecting and sorting material, comprising:

at least one material storage compartment of the motor vehicle having a plurality of locations for receiving the material;

a bin tipper configured to receive a collection bin containing the material;

a hopper located within the material storage compartment and configured to receive the material from the collection bin; and a guidance system configured to selectively move the hopper within the material storage compartment to any individual one of the plurality of locations in the material storage compartment, wherein the hopper and the guidance system are configured such that when material is received by the hopper from the bin tipper, the material is transported by the hopper to a desired individual one of the plurality of locations in the material storage compartment to allow the hopper to deposit the material into the desired individual one of the plurality of locations.

2. The motor vehicle of claim 1, wherein a plurality of containers are disposed in the material storage compartment of the motor vehicle, and the hopper and the guidance system are configured to selectively transport the material to the plurality of containers.

3. The motor vehicle of claim 2, wherein the plurality of containers are arranged in a first row along a driver side of the motor vehicle and a second row along a passenger side of the motor vehicle.

4. The motor vehicle of claim 1, wherein the bin tipper is configured to receive the collection bin at a ground level or a dock level depending on a loading level selected by an operator.

5. The motor vehicle of claim 1, wherein the guidance system comprises a plurality of vertical rails and horizontal rails along which the hopper is translated to transport the material to any individual one of the plurality of locations in the material storage compartment.

6. The motor vehicle of claim 1, wherein the hopper is configured to rotate up to 93 degrees in a single direction about a vertical axis in order to align with the desired individual one of the plurality of locations in the material storage compartment.

7. The motor vehicle of claim 1, wherein the hopper comprises side walls, a sloping bottom wall and a pivotally mounted door disposed at a front portion of the hopper, the pivotally mounted door configured to open to an upward position to discharge the material from the hopper to the desired individual one of the plurality of locations in the material storage compartment.

8. The motor vehicle of claim 1, wherein a width of the hopper is wider in a front portion of the hopper as compared to a width of a back portion of the hopper.

9. The motor vehicle of claim 1, wherein the hopper comprises a sloping side wall, two vertical side walls, a chute forming a fourth side wall and a sloped bottom wall, the chute pivot mounted to a bottom edge of the sloped bottom wall and configured to open to a downward declining position to discharge the material from the hopper to the desired individual one of the plurality of locations in the material storage compartment.

10. The motor vehicle of claim 9, wherein the chute is configured to open at a same slope as the sloped bottom wall to discharge the material from the hopper to the desired individual one of the plurality of locations in the material storage compartment.

11. The motor vehicle of claim 1, further comprising a vibrating motor mounted to a bottom of the hopper, the vibrating motor configured to provide force excitation to aid the hopper in discharging the material to the desired individual one of the plurality of locations in the material storage compartment.

12. The motor vehicle of claim 1, further comprising a storage area disposed between a passenger area and the material storage compartment, the storage area configured to provide access to an area around the hopper for maintenance or to store a container that is not in use.

13. A method for collecting and sorting material, comprising:

receiving a collection bin containing the material;

feeding the material, with a bin tipper, from the collection bin to a hopper located within a material storage compartment of a motor vehicle;

moving the hopper containing the material within the material storage compartment, with a guidance system that is configured to selectively move the hopper to any individual one of a plurality of locations in the material storage compartment, to a desired individual one of the plurality of locations in the material storage compartment;

discharging the material from the hopper to the desired individual one of the plurality of locations in the material storage compartment.

14. The method of claim 13, wherein the plurality of locations comprises a plurality of locations arranged in a first row along a driver side of the motor vehicle and a second row along a passenger side of the motor vehicle, each of the plurality of locations provided with a container configured to receive the material discharged from the hopper.

15. The method of claim 13, further comprising selecting one of a ground level or a dock level at which the collection bin is received by the bin tipper.

16. The method of claim 13, wherein moving the hopper to the desired individual one of the plurality of locations in the material storage compartment comprises translating the hopper along a plurality of vertical rails and horizontal rails.

17. The method of claim 13, wherein moving the hopper to the desired one of the plurality of locations in the material storage compartment comprises rotating the hopper up to 93 degrees in a single direction about a vertical axis.

18. The method of claim 13, wherein discharging the material from the hopper to the desired individual one of the plurality of locations in the material storage compartment comprises opening a pivotally mounted door of the hopper to an upward position such that the material is discharged from the pivotally mounted door via a sloped bottom wall of the hopper to the desired individual one of the plurality of locations in the material storage compartment.

19. The method of claim 13, wherein discharging the material from the hopper to the desired individual one of the plurality of locations in the material storage compartment comprises opening a chute forming a side wall of the hopper to a downward declining position, at a same slope as a sloped bottom wall of the hopper such that the material is discharged from the chute via the sloped bottom wall of the hopper to the desired individual one of the plurality of locations in the material storage compartment.

20. The method of claim 13, further comprising providing a force excitation configured to aid in discharging the material to the to the desired individual one of the plurality of locations in the material storage compartment via a vibrating motor mounted to a bottom of the hopper.

* * * * *